United States Patent [19]

Hannebaum

[11] 4,181,117

[45] Jan. 1, 1980

[54] FIREPLACE

[76] Inventor: Harold W. Hannebaum, 420 Walnut St. East, Bellevue, Id. 83313

[21] Appl. No.: 843,827

[22] Filed: Oct. 20, 1977

Related U.S. Application Data

[63] Continuation-in-part of Ser. No. 762,014, Jan. 24, 1977, abandoned.

[51] Int. Cl.[2] ..... F24B 1/18

[52] U.S. Cl. ..... 126/120; 126/142

[58] Field of Search ..... 126/120, 121, 140, 142, 126/135, 202

[56] References Cited

U.S. PATENT DOCUMENTS

| | | | |
|---|---|---|---|
| 3,499,432 | 3/1970 | Hannebaum | 126/120 |
| 3,616,788 | 11/1971 | Hannebaum | 126/140 |

FOREIGN PATENT DOCUMENTS

| | | | |
|---|---|---|---|
| 568197 | 3/1945 | United Kingdom | 126/142 |

*Primary Examiner*—Robert L. Wolfe
*Attorney, Agent, or Firm*—Howard I. Podell

[57] ABSTRACT

A fireplace heating unit provided with a firebox. A vertically elongated hollow member defining in horizontal cross section a square and formed primarily of transparent material, is open at both ends and is secured at its lower end to the firebox. A hollow top section having a relatively small open upper end which defines a chimney and a lower open and conforming to and engaging the upper end of said member has a narrow horizontal peripheral border having the same shape and essentially the perimeter as said square. Shaped openings partially blocked by louvers are formed in the border of the top section.

4 Claims, 5 Drawing Figures

FIREPLACE

This application is a continuation-in-part of application Ser. No. 762,014, filed Jan. 24, 1977, now abandoned.

BACKGROUND OF THE INVENTION

On Mar. 10, 1970, applicant was awarded U.S. Pat. No. 3,499,432, entitled Heating Unit. This patent disclosed a wood burning fireplace employing a firebox supported on a vertical pedestal. A vertical hollow cylinder formed primarily of glass, open at upper and lower ends, and having at least one vertical air intake slot was secured at its lower end to the firebox and extended upward. A vertical hollow truncated cone open at both ends was secured at its bottom and larger end to the upper end of the cylinder and has a chimney or smokestack in its top and smaller end. When fuel is burned in the firebox, the air entering swirls upward in a generally helical pattern of ever decreasing diameter, providing an enhanced lighting effect and keeping the windows clear and free of smoke.

SUMMARY OF THE INVENTION

In accordance with the principles of this invention, a firebox is disposed in the bottom open end of a vertically elongated hollow member formed primarily of glass. The top open end of the member is disposed in the open bottom end of a hollow top section which extends upward to an open top end of a relatively small area which contains a chimney or smokestack. The bottom end of the section is provided with a horizontal narrow border formed with individual shaped openings communicating with the open top end of the member; this border having essentially the same perimeter as that of the member.

When fire is burned in the firebox, intake air swirls downwardly along the inner surfaces of the member, keeping the glass surfaces clean and clear. The air then swirls upward out of the chimney. The swirling action differs in appearance from that obtained by the use of the aforementioned patent but also produces an enhanced lighting effect. The flow of air through the border openings can be regulated as necessary by employing a fixed or manually adjustable louver in the border opening.

BRIEF DESCRIPTION OF THE DRAWINGS

In the accompanying drawing, in which is shown one of the various possible illustrative embodiments of this invention, wherein like reference character identify the same or like parts.

DETAILED DESCRIPTION OF PREFERRED EMBODIMENT

Figure 1:
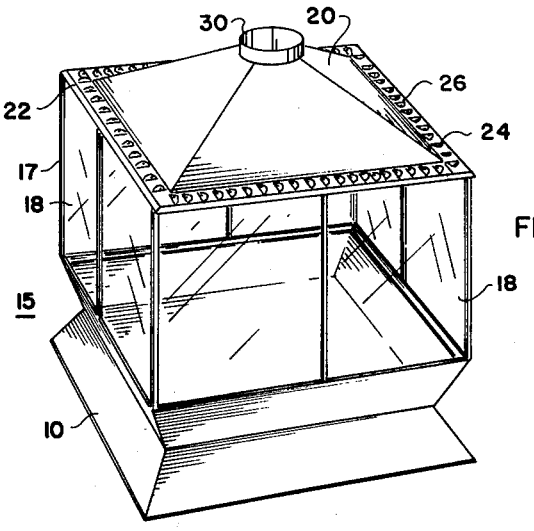
FIG. 1 is a perspective view of the invention.
Figure 2:
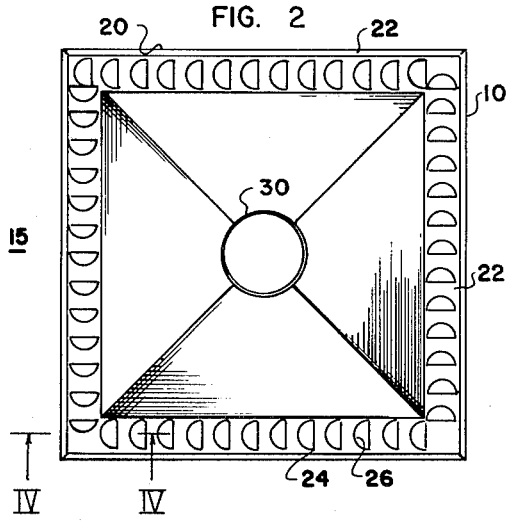
FIG. 2 is a top view thereof.
Figure 3:
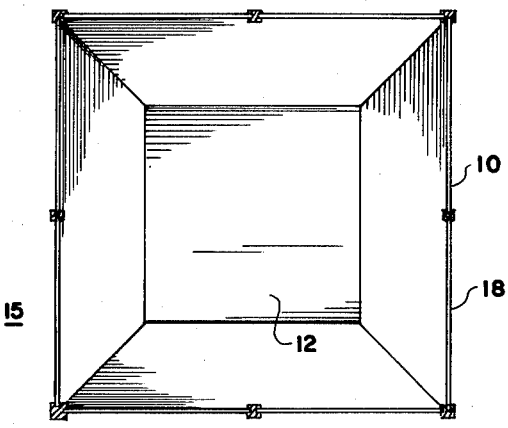
FIG. 3 is a bottom view thereof.
Figure 4:
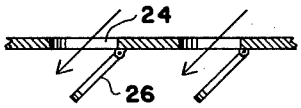
FIG. 4 is a detail view taken along line IV—IV in FIG. 1.

Referring now to FIGS. 1–4, fireplace 15 rests on a pedestal 10 which supports a firebox 12 having a square shaped periphery. A vertical hollow body or member open at both ends takes the form of a frame 17 containing vertical panes of glass 18. The member in horizontal cross section defines a square with one or two panes per side.

A hollow metal hood identified generally at 20 has an open bottom square shaped end 22 which rests upon and extends over the sides of the upper end of the frame. The hood tapers upward and inward to a vertical pipe, chimney or smokestack 30 which is open and has a cross sectional area which is small with respect to that of the bottom end of the hood.

Bottom end of hood 20 is formed as a flat square-shaped flange border 22, overlying the inner surfaces of the corresponding sides of the glass panes. Shaped openings in border 22 may be each partially blocked by a fixed or adjustable louver 26 internally mounted to border 22 within the interior of the frame 17, to control air flow into the interior through openings 24.

Louvers 26 are each in the form of a flat vane and each oriented with respect to an opening 24 so that when fuel is burned in the firebox, intake air flows or swirls downwardly through the opening 24 and along the inner surfaces of the glass, keeping these surfaces clear and clean. The heated air then swirls upwardly and out the chimney as previously described.

Figure 5:
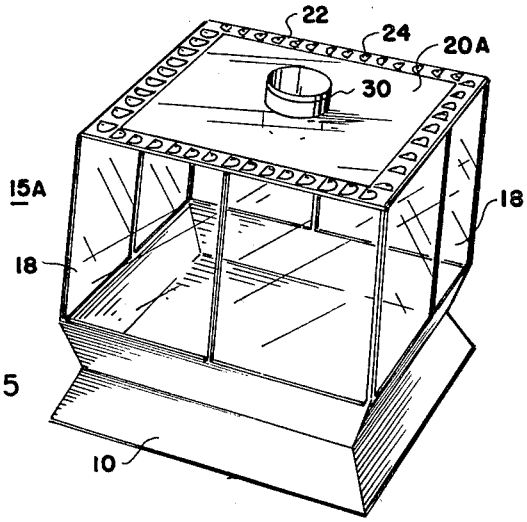
FIG. 5 is a perspective view of an alternative embodiment of the invention.

The cross sectional shape of the member can be square, round, oval, pentagon, hexagon or octagon and the same results can be obtained. As shown in FIG. 5, an alternative embodiment 15A of similar construction may be formed with a flat horizontal hood 20A substituted for the tapered hood 20 of the fireplace 15.

While the invention has been described with particular reference to the drawings, the protection sought is to be limited only by the terms which follow.

Having thus described the invention, what I claim as new and desire to secure by Letters Patent of the United States is:

1. A heating unit comprising a firebox;

a vertically elongated hollow member formed primarily with a plurality of vertical sides of transparent material, said member being open at both vertical ends and secured at its lower end to the firebox; and a hollow top section formed with a central chimney outlet having a relatively small open end conforming to and engaging the upper end of said vertically elongated hollow member, said section having a narrow horizontal peripheral border with openings in said border communicating with the upper interior of said vertially elongated hollow member, said border having essentially the same perimeter as that of said member, in which said horizontal border has a plurality of manually adjustable louvers therein, each associated with an individual such opening and located so that, in use, air is drawn into the member through each opening and oriented by each said louver along a vertically downwardly extending swirling path and is discharged upwardly through a chimney joined to the said small open end of the hollow top section, with each said louver oriented to pivot about an axis perpendicular to a vertical side of the said hollow member, adjacent to said louver, such that air drawn through an opening is directed by an associated louver along a downward path sidewards along the inner surfaces of the glass when the louver is pivoted in a plane that is diagonal to the vertical and horizontal axes of the heating unit.

2. The combination as recited in claim 1 in which all louvers are aligned to pivot along individual diagonal planes such that the entering air impacted by such louvers is caused to flow in a common rotational direction as seen in plan view, such as to cause the air to continue to rotate in said direction in the central section of the firebox as it exits upwards through the chimney outlet in the top section, said rotation of the air serving to clean the interior surfaces of a chimney to which the chimney outlet is joined.

3. The unit of claim 1, wherein said louver is mounted by fixed means to said border.

4. The unit of claim 1, wherein said louver is mounted by adjustable means to said border.

* * * * *